US005195491A

United States Patent [19]

Kuroda

[11] Patent Number: 5,195,491

[45] Date of Patent: Mar. 23, 1993

[54] METHOD AND APPARATUS FOR CONTROLLING AN ENGINE

[75] Inventor: Toshiki Kuroda, Himeji, Japan

[73] Assignee: Mitsubishi Denki Kabushiki Kaisha, Tokyo, Japan

[21] Appl. No.: 870,279

[22] Filed: Apr. 17, 1992

[30] Foreign Application Priority Data

May 14, 1991 [JP] Japan ..... 3-108002

[51] Int. Cl.[5] ..... F02D 41/10

[52] U.S. Cl. ..... 123/492

[58] Field of Search ..... 123/492; 364/431.07

[56] References Cited

U.S. PATENT DOCUMENTS 4,706,634 11/1987 Nishikawa et al. ..... 123/492
4,896,644 1/1990 Kato ..... 123/492
4,996,644 2/1991 Fukuchi et al. ..... 364/431.05

FOREIGN PATENT DOCUMENTS 3934498 4/1990 Fed. Rep. of Germany .
5427491 9/1979 Japan .
195345 10/1985 Japan ..... 123/492
32233 2/1987 Japan ..... 123/492

OTHER PUBLICATIONS

Bosch Techn. Berichte 7 (1981), pp. 139-151.

*Primary Examiner*—Tony M. Argenbright
*Attorney, Agent, or Firm*—Sughrue, Mion, Zinn, Macpeak and Seas

[57] ABSTRACT

A method and apparatus for controlling an engine involves detecting a crank angle of an engine; detecting a rotation number of the engine based on the crank angle; detecting an injection timing by a fuel injection valve; determining an acceleration state; calculating a time period from injection to acceleration initiation based on the acceleration state and the injection timing; detecting a load of the engine; determining an injection correction value based on at least the acceleration initiation timing and the rotation number of the engine; determining a fuel injection pulse width based on the injection correction value, and controlling the fuel injection valve accordingly.

2 Claims, 7 Drawing Sheets

FIGURE 7

| NO \ t | 0 | 10 | 20 | 30 | 40 | 50 | 60 | 70 | 80 | 90 | 100 | 110 | 120 | 130 | 140 | 150 | 160 | 170 | 180 | 190 | 200 | 210 | 220 | 230 | 240 |
|---|---|---|---|---|---|---|---|---|---|---|---|---|---|---|---|---|---|---|---|---|---|---|---|---|---|
| 500 | O | O | O | O | O | O | O | O | O | O | O | O | O | O | O | O | O | O | O | O | O | O | O | O | O |
| 750 | O | O | O | O | O | O | O | O | O | O | O | O | O | O | O | O | O | O | O | O | O | O | O | O | O |
| 1000 | O | O | O | O | O | O | O | O | O | O | O | O | O | O | O | O | O | | | | | | | | |
| 1250 | O | O | O | O | O | O | O | O | O | O | O | O | O | | | | | | | | | | | | |
| 1500 | O | O | O | O | O | O | O | O | O | O | O | | | | | | | | | | | | | | |
| 1750 | O | O | O | O | O | O | O | O | O | | | | | | | | | | | | | | | | |
| 2000 | O | O | O | O | O | O | O | O | | | | | | | | | | | | | | | | | |
| 2250 | O | O | O | O | O | O | O | | | | | | | | | | | | | | | | | | |
| 2500 | O | O | O | O | O | O | O | | | | | | | | | | | | | | | | | | |
| 2750 | O | O | O | O | O | O | | | | | | | | | | | | | | | | | | | |
| 3000 | O | O | O | O | O | O | | | | | | | | | | | | | | | | | | | |

METHOD AND APPARATUS FOR CONTROLLING AN ENGINE

BACKGROUND OF THE INVENTION

1. Field of the Invention

This invention relates to a method and apparatus for controlling an engine which prevents a phenomena wherein a mixture is diluted (hereinafter, called "leanness phenomena") by correcting a fuel supply quantity in acceleration time.

2. Discussion of Background

A conventional control of this kind is shown, for instance, in Japanese Examined Patent Publication No. 27491/1989, wherein a fuel injection quantity is increased during acceleration times.

In the conventional control, the increase of fuel is controlled in accordance with an acceleration state, wherein an increase of wasteful fuel is prevented by increasing only the fuel necessary for the acceleration, or by reducing the increase quantity of fuel in the acceleration time, inversely to an increase in the rotational number of the engine, whereby purification of exhaust gas and saving of fuel are performed.

In the conventional control, a corrected fuel quantity determined by an acceleration state and the rotation number, is injected at an injection timing which succeeds an acceleration initiation. Accordingly, a large amount of air is sucked in a time period from the acceleration initiation to the succeeding injection timing, which causes the leanness phenomena. Therefore, in the acceleration time, knocking is generated and much nitrogen oxides ($NO_x$) contained in the exhaust gas is emitted, which contaminates the air.

SUMMARY OF THE INVENTION

It is an object of the present invention to provide a method and apparatus for controlling an engine which prevents the generation of knocking and decreases the emission quantity of $NO_x$.

According to an aspect of the present invention, there is provided a method/apparatus for controlling an engine comprising:

crank angle detecting means for detecting a crank angle of an engine;

rotation number detecting means for detecting a rotation number of the engine based on an output of the crank angle detecting means;

injection timing detecting means for detecting an injection timing by a fuel injection valve;

acceleration determining means for determining an acceleration state;

acceleration initiation timing calculating means for calculating a time period from injection to acceleration initiation based on an output of the acceleration determining means and an output of the injection timing detecting means;

load detecting means for detecting a load of the engine;

injection correction value determining means for determining an injection correction value based on at least an output of the acceleration initiation timing calculating means and the rotation number of the engine; and fuel injection valve controlling means for determining a fuel injection pulse width based on the injection correction value and controlling the fuel injection valve.

In controlling an engine according to the present invention, the time period from when the injection is performed to when the acceleration is initiated, is measured, the correction quantity is determined in accordance with this time period, the rotation number and the load, and the correction is performed at the succeeding injection or until the succeeding injection, by which the leanness phenomena in the acceleration time can be prevented and the generation of knocking or an emission quantity of $NO_x$ can be reduced.

BRIEF DESCRIPTION OF THE DRAWINGS

FIG. 7 is a correction pulse width table for explaining the invention;

DETAILED DESCRIPTION OF THE PREFERRED EMBODIMENTS

Figure 1:
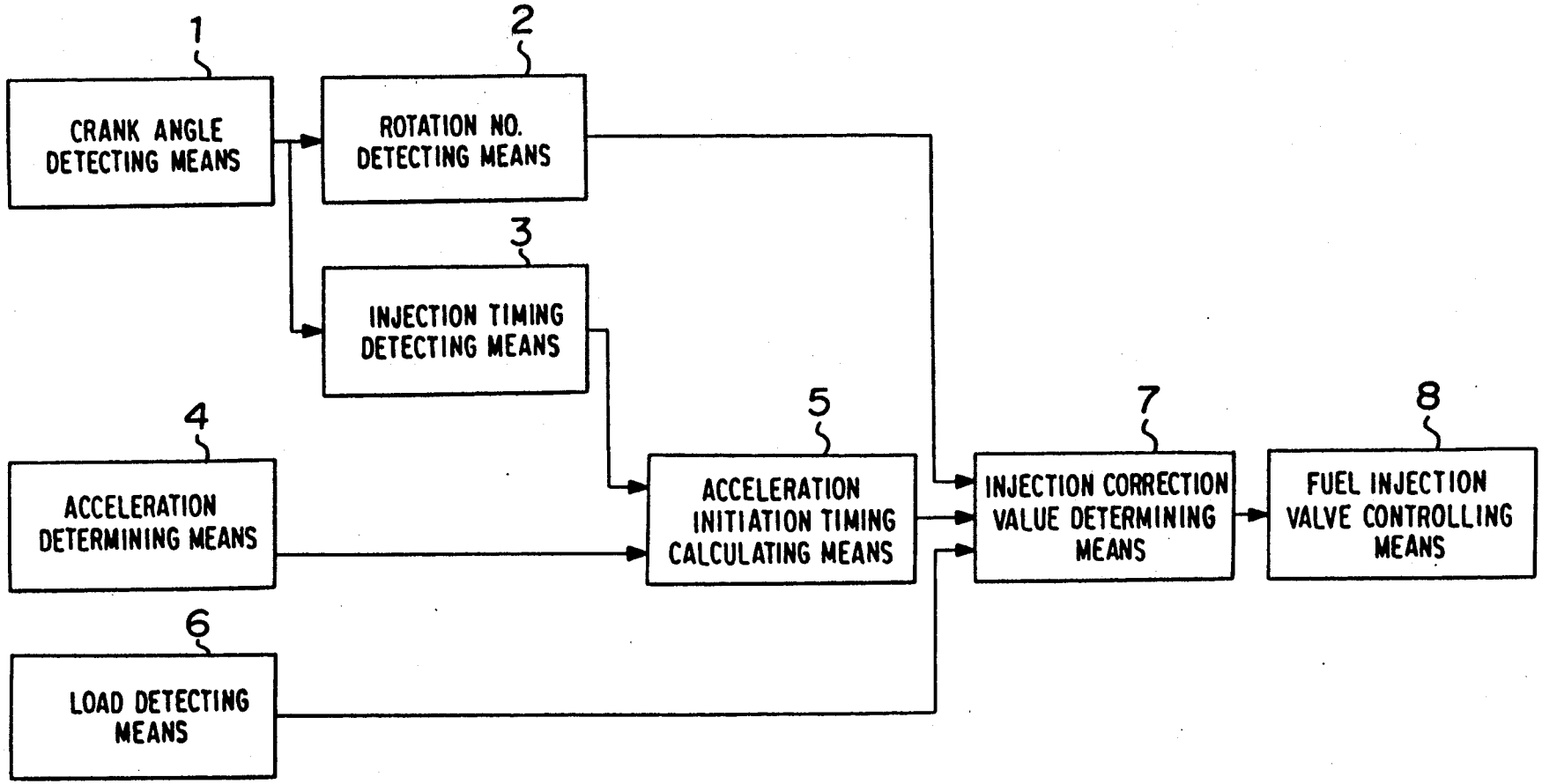
FIG. 1 is a block diagram showing a basic construction of an apparatus controlling an engine according to the present invention.

Explanation will be given to an embodiment of the present invention referring to the drawings as follows. FIG. 1 is a block diagram wherein reference numeral 1 designates a crank angle detecting means for detecting a crank angle of the engine, which is a crank angle sensor 18 in FIG. 2. A numeral 2 designates a rotation number detecting means for detecting a rotation number of the engine by obtaining a timing period for signal generation based on an output $S_3$ of the crank angle detecting means 1. A numeral 3 designates an injection timing detecting means, which obtains a leading edge of a signal based on an output $S_3$ of the crank angle detecting means 1, and detects a driving initiation edge of an injector 14 that performs injection in synchronism with the leading edge. A numeral 4 designates an acceleration determining means which performs an acceleration determination by obtaining a change quantity of a signal from a throttle position sensor, not shown, linked to a throttle valve 12 of FIG. 2, or an output signal $S_4$ of an air-flow sensor 10.

Figure 2:
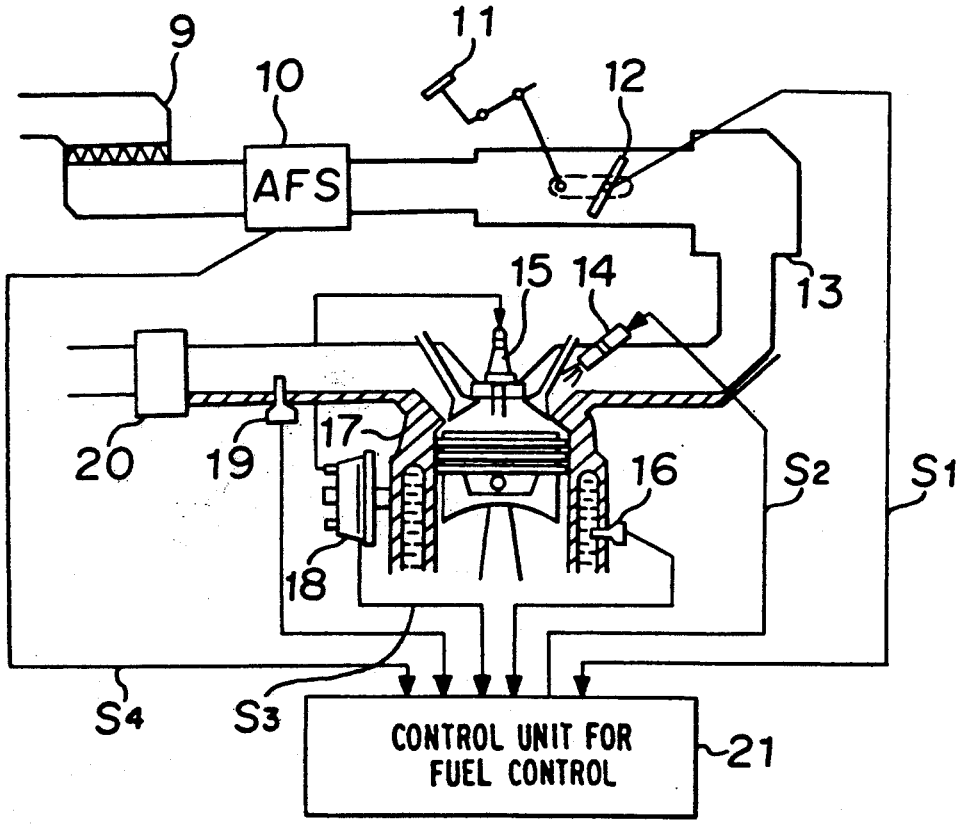
FIG. 2 is an outline diagram of the engine wherein the invention is performed.
Figures 3A, 3B, 3C, 3D, 3E, 3F:
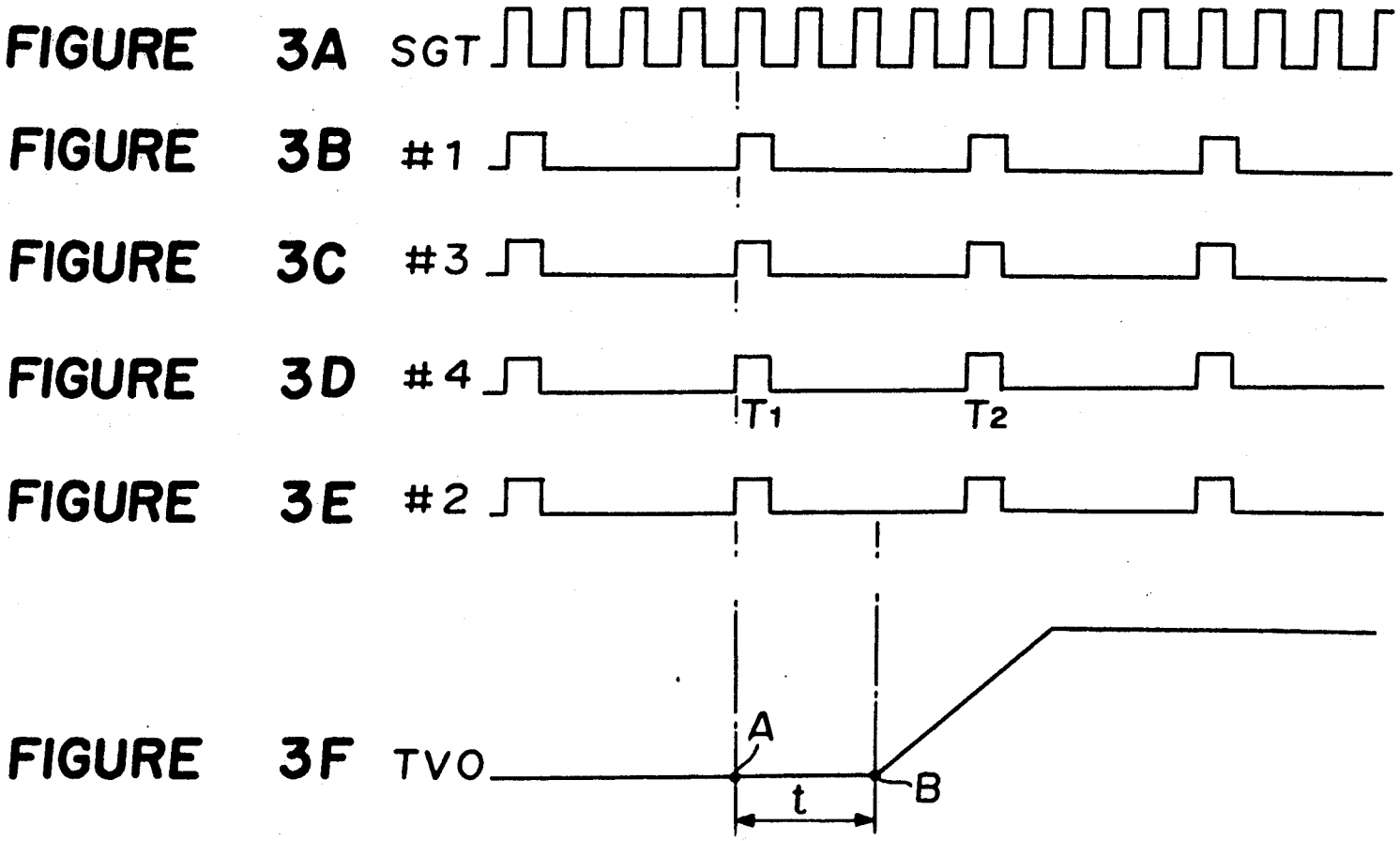
FIGS. 3A to 3F are waveform diagrams showing injection timings of injectors according to the present invention.
Figure 8:
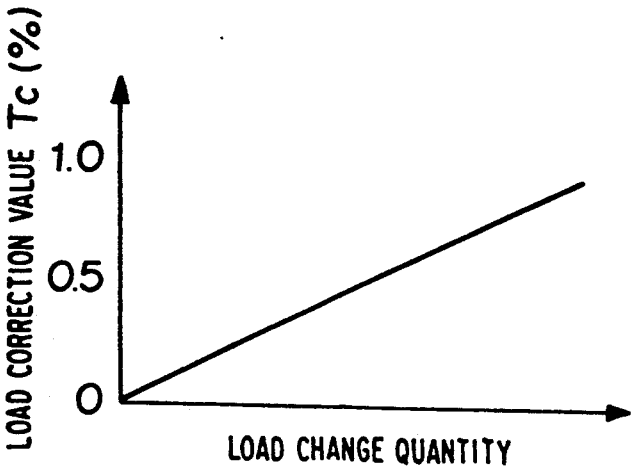
FIG. 8 is a graph showing a relationship between a load changing quantity and a load correction value for explaining the invention.

A numeral 5 designates an acceleration initiation timing calculating means, which calculates a time period "t" between point A obtained by the injection timing detecting means and point B obtained by the acceleration determining means, as shown in FIG. 3F. A numeral 6 designates a load detecting means for detecting a load of the engine, which is, for instance, the air-flow sensor 10 in FIG. 2, or a throttle position sensor. A numeral 7 designates an injection correction value determining means, which reads data Th from a correction pulse width data table that is previously written in a ROM (read only memory) having parameters of the engine rotation number and the acceleration initiation timing, obtains a load correction value Tc in accordance with a load change quantity, as shown in FIG. 8 and determines an injection correction value To by the following Equation (1).

$$To = Th \times Tc \quad (1)$$

Furthermore, it is possible to perform a similar correction by the data Th written in the ROM as a correction value.

When a fuel injection valve controlling means 8 receives the correction value To of an output of the injection correction value determining means 7, the fuel injection valve control means 8 performs a provisional injection by interruption in addition to injections synchronized with an SGT signal 3*a* such as $T_1$ and $T_2$ shown in FIGS. 3B through 3E. For in stance, in case of acceleration as shown in FIG. 3F, injection is performed with the correction pulse width To in accordance with "t", the rotation number and the load change quantity in a time range from point B to the injection at $T_2$. In this occasion, instead of this case of the provisional injection, the injection can be performed with the correction pulse width added with that of the synchronous injection at $T_2$, or both pulse widths of the provisional injection and the synchronous injection can be corrected.

FIG. 2 is an outline view of the engine, wherein reference numeral 21 designates a control unit for fuel control composed of a CPU or the like, which detects an intake quantity of an engine 17 by the air-flow sensor 10, detects the rotation number of the engine based on an output $S_3$ of the crank angle sensor 18, calculates the basic pulse width Tp in correspondence with the intake quantity and the rotation number, obtains a correction quantity for a temperature correction based on an output of a water temperature sensor 16 and for various corrections Co, obtains an air-fuel ratio feedback correction coefficient quantity K based on an output of an exhaust gas sensor 19, and finally obtains an injection pulse width Ti by the following Equation (2) assuming a voltage correction quantity as Ts.

$$Ti = Tp \times Co \times K + Ts \quad (2)$$

A combustion control is performed by driving an injector 14 based on the obtained injection pulse Ti. An output $S_1$ of the throttle position sensor, not shown, which links to the throttle valve 12 or an output $S_4$ of the air-flow sensor 10, is changed by pushing on an accelerator pedal 11. An acceleration determination is performed by the change quantity. When the engine is determined to be accelerating, a time period from a preceding injection timing just before the acceleration to when the acceleration is initiated, is obtained, the correction pulse Th which is previously memorized in a memory is obtained from the time period and the rotation number, and the correction value To with respect to the acceleration initiation timing is obtained by obtaining the correction value Tc in accordance with the load change quantity. The injector 14 is provisionally driven by the correction pulse value To, or by a value of To added to Ti in Equation (2), so that the air-fuel ratio lean spike is prevented. In FIG. 2, a numeral 9 designates an air cleaner, 13, a surge tank, 15, an ignition plug, 20, a catalyst and a notation $S_2$, an injector driving signal, respectively.

Figure 4:
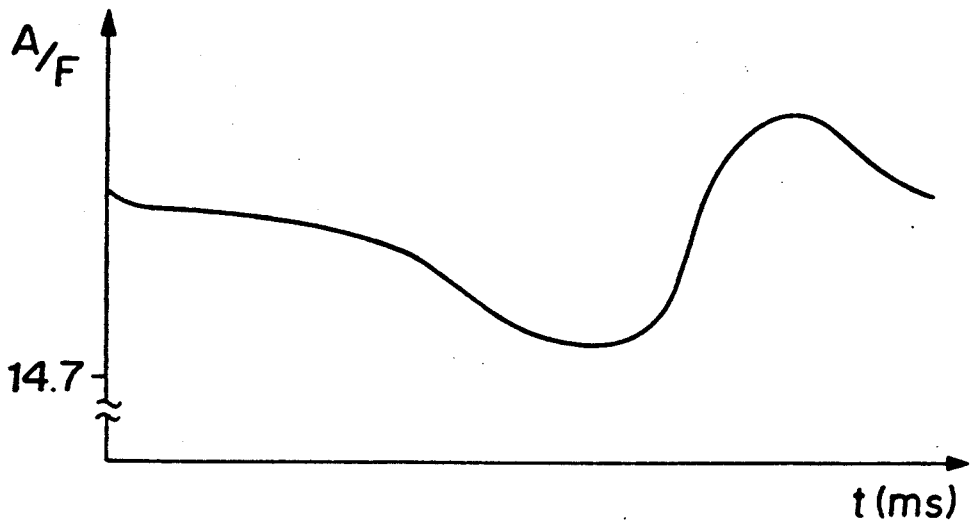
FIG. 4 is a correlation diagram showing a relationship between an acceleration initiation timing and an air-fuel ratio lean spike in a conventional control method.

Next, the operation of the present invention will specifically explained. FIG. 4 is a diagram showing a relationship between the acceleration initiation timing and the air-fuel ratio lean spike. In the conventional device, the increase of fuel is performed in accordance with the acceleration state and the correlation based on the acceleration initiation timing is not performed at all. Therefore, the leanness phenomena is caused depending on the acceleration initiation timing, even when the acceleration is performed under the same condition.

This invention is carried out to prevent the leanness phenomena due to the acceleration and to dispense with a variation of the leanness phenomena. Explanation will be given to the control method referring to the flowchart of FIG. 9.

Figure 9:
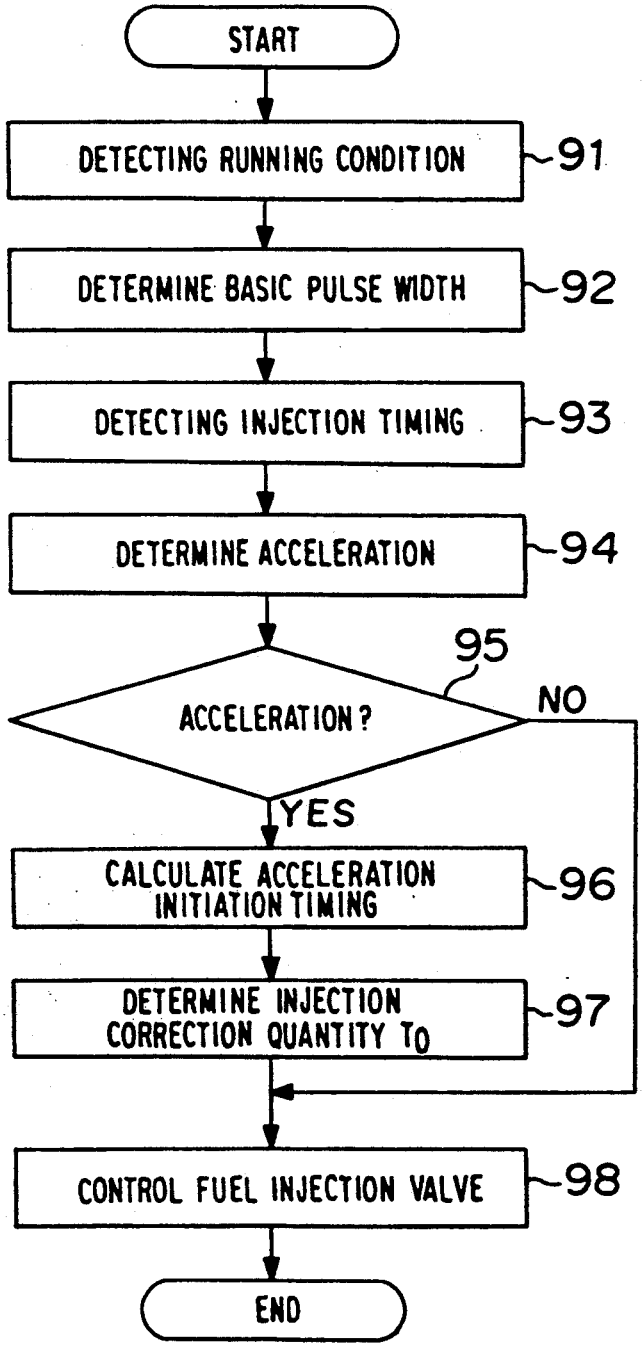
FIG. 9 is a flowchart for explaining the operation of an embodiment of the present invention.

In FIG. 9, first, in step 91, the operation detects the engine rotation number based on the timing period of the output $S_3$ of the crank angle sensor 18 and detects a load state of the engine based on the output $S_4$ of the air-flow sensor 10 and proceeds to step 92. In step 92, the operation determines the basic injection pulse width Tp in accordance with the running condition obtained in step 91. Next, in step 93, the operation detects the leading edge of the driving pulse of the injector 14 which performs the injection in synchronism with the leading edge of the SGT signal 3*a* of the output signal $S_3$ of the crank angle sensor 18. For instance, as shown in FIGS. 3B through 3E, in case of the synchronous injection once per 2 revolutions, the operation detects the leading edge, point A of the respective cylinder driving pulses.

In step 94, the operation A/D-converts the output $S_1$ of the throttle position sensor which links to the throttle valve 12, and obtains the difference ΔTVO between the preceding throttle opening degree $TVO_{(i-1)}$ and the current throttle opening degree $TVO_{(i)}$ by the following Equation (3).

$$\Delta TVO = TVO_{(i)} - TVO_{(i-1)} \quad (3)$$

When a value of ΔTVO is a predetermined value or more, the operation determines as the engine is accelerating. Furthermore, in this acceleration determination, the output $S_4$ of the air-flow sensor 10 can be utilized, and it is possible to perform the acceleration determination similarly by utilizing a mechanical acceleration detection switch. After the acceleration determination, the operation proceeds to step 95. In step 95, the operation performs the determination whether the engine is accelerating or not, based on the result of the acceleration determination. When the engine is not accelerating, the operation proceeds to step 98 and performs injection without acceleration correction. When the engine is accelerating, the operation proceeds to step 96, and performs a calculation treatment of the acceleration initiation timing. In the calculation in step 96, the time period "t" between point A obtained in step 93 and point B obtained in step 94, is measured by a timer function in the CPU. This timer is composed to reset at every leading edge of the driving pulses 3B through 3E of the injector.

Figure 5:
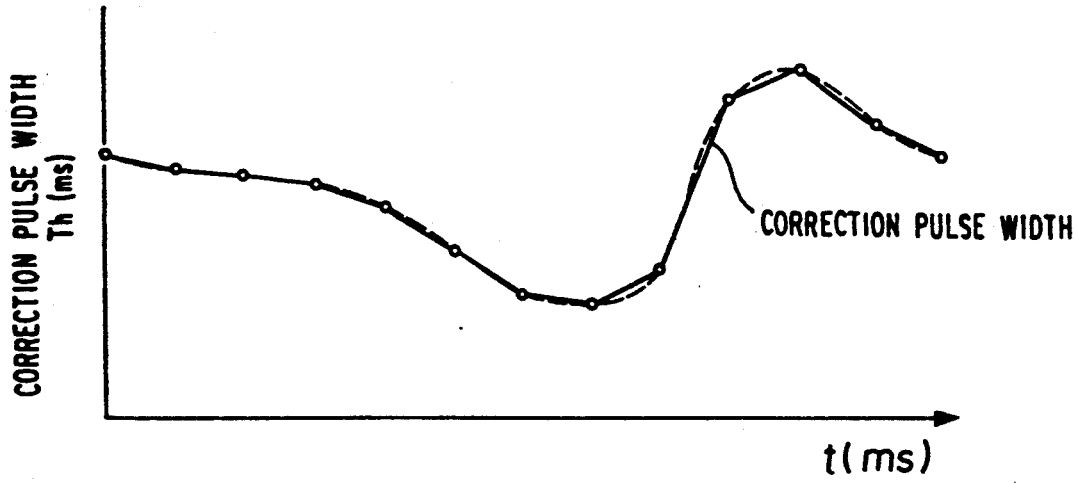
FIG. 5 is a graph showing a tendency of the acceleration initiation timing and a correction pulse width according to the present invention.
Figure 6:
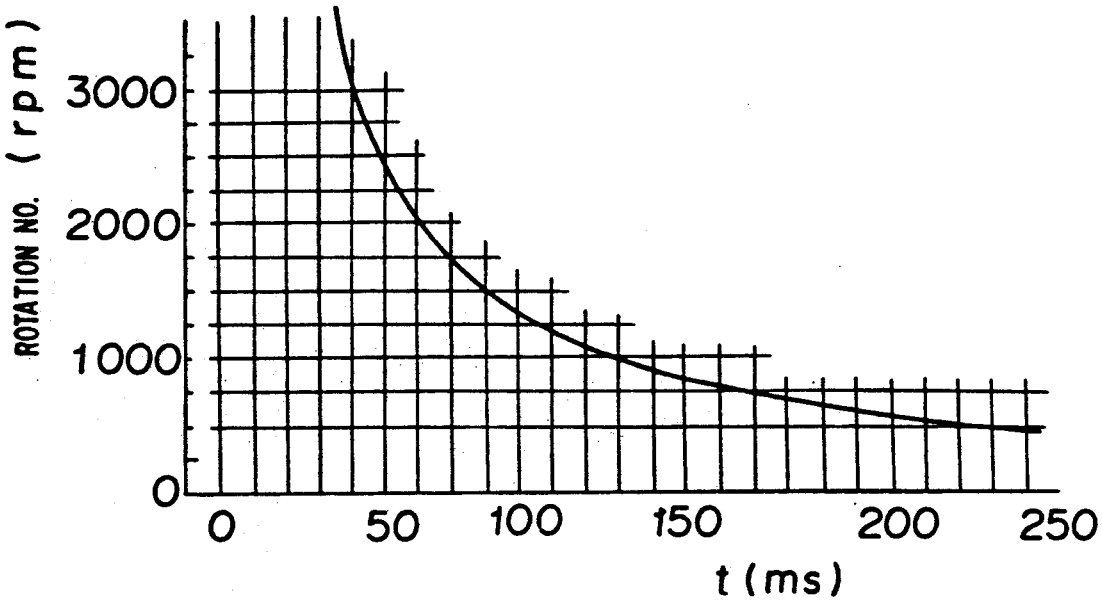
FIG. 6 is a graph which accompanies FIG. 7 for explaining the invention.

Next, the operation proceeds to step 97, wherein the operation sets the correlation data of the acceleration initiation timing "t" and the correction pulse Th as shown in FIG. 5, using the output of the rotation number detecting means 2 for detecting the rotation number of the engine and the output of the acceleration initiation timing calculating means 5 obtained in step 96, as parameters, at the respective rotation numbers and with respect to the lattice points in FIG. 6, and determines the correction pulse width Th by performing a table look-up of the correction pulse width table shown in FIG. 7, which is previously written in a memory (ROM).

Furthermore, the operation obtains the load change quantity due to the acceleration based on an output of the load detecting means 6, performs correction on the correction pulse width Th by using the load correction value Tc in accordance with the load changing quantity shown in FIG. 8, by which the operation determines the acceleration initiation timing correction pulse value To, and proceeds to step 98. In step 98, the operation performs the injection by driving provisionally and nonsynchronizingly with the SGT signal, the injector 14 with a pulse of the correction value To. This provisional injection is performed by an interruption treatment, and the normal synchronizing injection is performed after the provisional injection. In this example, a case is shown wherein the synchronous injection is performed once per 2 revolutions. However, naturally the similar correction can be performed for a case of the synchronous injection once per 1 revolution, or a synchronous injection of two cylinders or a successive injection.

In the conventional case, the correction by the acceleration initiation timing is not performed and the leanness phenomena shown in FIG. 4 is generated. According to the present invention, the time period between the injection and the acceleration initiation is calculated and the correction pulse is determined in accordance with the time period and the revolution number. Furthermore, the correction value is obtained which is corrected in accordance with the change quantity of the load, based on which the injector 14 is controlled. In this way, it is possible to prevent the air-fuel leanness phenomena as in the conventional example and to dispense with the variation of the leanness phenomena, by which the generation of knocking can be prevented and the purification of the exhaust gas can be performed.

In the above example, a case is shown wherein the correction pulse width Th is obtained by performing the table look-up in step 97, and the correction quantity of To wherein the correction pulse width Th is further corrected by the load, is injected nonsynchronizingly in step 98. However, the data previously set in the memory which is read in step 97 may not be an absolute value of the correction pulse width, and a relative correction value may be obtained from the relationship of FIG. 4, which may previously be set as the table shown in FIG. 7. Furthermore, in step 97, the operation may obtain the correction value Th' by performing a table look-up, utilizing the output of the acceleration initiation timing calculating means and the output of the rotation number detecting means as parameters, obtain the correction value Tc from the output of the load detecting means as shown in FIG. 8, obtain the correction value To' at the acceleration initiation timing by the following Equation (4) and proceeds to step 98.

$$To' = Th' \times Tc \quad (4)$$

In step 98, the operation determines the injection pulse Ti by performing a correction using the following Equation (5) of the basic injection pulse Tp obtained in step 92, the correction quantity by the water temperature or the like Co, the voltage correction value Ts and the feedback correction coefficient K.

$$Ti = Tp \times Co \times K \times To' + Ts \quad (5)$$

A correction injection of the injector 14 can be performed at the injection timing just after the acceleration, synchronized with the SGT signal of the injector 14, and utilizing the injection pulse width Ti obtained by Equation (5), with an effect similar to the above example.

As stated above, according to the present invention, by controlling the drive of the fuel injection valve by changing the acceleration correction quantity in accordance with the acceleration initiation timing, the engine rotation number and the load change quantity, the leanness phenomena due to the acceleration initiation timing in the acceleration time, can be prevented and the variation of the leanness phenomena can be dispensed with. Therefore, the invention has an excellent effect wherein the generation of knocking due to the leanness phenomena and the emission quantity of $NO_x$ emitted to the air can be decreased.

What is claimed is:

1. An apparatus for controlling an engine comprising:
   - crank angle detecting means for detecting a crank angle of an engine;
   - rotation number detecting means for detecting a rotation number of the engine based on an output of the crank angle detecting means;
   - injection timing detecting means for detecting an injection timing by a fuel injection valve;
   - acceleration determining means for determining an acceleration state;
   - acceleration initiation timing calculating means for calculating a time period from injection to acceleration initiation based on an output of the acceleration determining means and an output of the injection timing detecting means;
   - load detecting means for detecting a load of the engine;
   - injection correction value determining means for determining an injection correction value based on at least an output of the acceleration initiation timing calculating means and the rotation number of the engine; and
   - fuel injection valve controlling means for determining a fuel injection pulse width based on the injection correction value and controlling the fuel injection valve.

2. A method of controlling an engine, comprising the steps of:
   - detecting a crank angle of an engine;
   - detecting a rotation number of the engine based on the detected crank angle;
   - detecting an injection timing by a fuel injection valve;
   - determining an acceleration state;
   - calculating a time period from injection to acceleration initiation based on the determined acceleration state and the detected injection timing;
   - detecting a load of the engine;
   - determining an injection correction value based on at least the calculated acceleration initiation timing and the rotation number of the engine;
   - determining a fuel injection pulse width based on the injection correction value, and
   - controlling the fuel injection valve in accordance with the fuel injection pulse width.

* * * * *